US007355331B2

(12) United States Patent
Taniwa et al.

(10) Patent No.: US 7,355,331 B2
(45) Date of Patent: Apr. 8, 2008

(54) CATHODE-RAY TUBE APPARATUS

(75) Inventors: Kenichiro Taniwa, Takatsuki (JP); Hideaki Etou, Hirakata (JP)

(73) Assignee: Matsushita Toshiba Picture Display Co., Ltd., Osaka (JP)

( * ) Notice: Subject to any disclaimer, the term of this patent is extended or adjusted under 35 U.S.C. 154(b) by 493 days.

(21) Appl. No.: 11/051,123

(22) Filed: Feb. 4, 2005

(65) Prior Publication Data

US 2005/0174036 A1 Aug. 11, 2005

(30) Foreign Application Priority Data

Feb. 10, 2004 (JP) ..... 2004-033894

(51) Int. Cl.
*H01J 29/86* (2006.01)
*H01J 29/70* (2006.01)

(52) U.S. Cl. ..... 313/477 R; 313/440; 313/421; 220/2.1 A

(58) Field of Classification Search ..... 313/477, 313/440, 441, 421, 433; 220/2.1 A, 2.1 R
See application file for complete search history.

(56) References Cited

U.S. PATENT DOCUMENTS 5,801,481 A * 9/1998 Yokota ..... 313/440
6,657,374 B1 * 12/2003 Nagasawa et al. ..... 313/477 R
6,680,567 B2 * 1/2004 Sugawara et al. ..... 313/477 R
2002/0153823 A1 10/2002 Hergott et al.
2003/0214220 A1 * 11/2003 Kugo et al. ..... 313/477 R
2004/0090559 A1 5/2004 Kyono et al.
2004/0227450 A1 11/2004 Murakami

FOREIGN PATENT DOCUMENTS

| | | |
|---|---|---|
| JP | 1-818855 | 5/1989 |
| JP | 2001-525116 | 12/2001 |
| JP | 2002-237266 | 8/2002 |
| WO | 99/46796 | 9/1999 |
| WO | 03/034461 | 4/2004 |

* cited by examiner

*Primary Examiner*—Joseph Williams
*Assistant Examiner*—Trent Schindler
(74) *Attorney, Agent, or Firm*—Hamre, Schumann, Mueller & Larson, P.C.

(57) ABSTRACT

In a cross-section including a tube axis, assuming that T1 represents a thickness of a funnel at a point on an outer circumferential surface of the funnel, which is placed at the same position in a tube axis direction as that of an end of a horizontal deflection coil on a phosphor screen side, and T2 represents a thickness of the funnel at a point on the outer circumferential surface of the funnel, which is placed at the same position in the tube axis direction as a position 7 mm away from the end of the horizontal deflection coil on the phosphor screen side to the phosphor screen side along the tube axis, the funnel includes at least one cross-section including the tube axis satisfying a relationship: T2/T1≧1.18. Owing to this, cone halation can be prevented while an X-ray leakage amount is limited to a predetermined value or less.

2 Claims, 3 Drawing Sheets

CATHODE-RAY TUBE APPARATUS

BACKGROUND OF THE INVENTION

1. Field of the Invention

The present invention relates to a cathode-ray tube apparatus.

2. Description of the Related Art

Recently, there is an increasing demand for flattening and enlarging the display screen of a cathode-ray tube apparatus. In order to satisfy this demand while ensuring predetermined mechanical strength, it is necessary to increase the thickness of a glass bulb for a cathode-ray tube, which consequently leads to an increase in weight.

JP2002-237266A describes a glass funnel for a cathode-ray tube, capable of simultaneously realizing sufficient strength withstanding vacuum breakdown and reduction in weight. In this funnel, a difference in level is formed on an outer surface of the funnel in the vicinity of a portion connected to a front panel in such a manner that the thickness is large at the portion connected to the front panel, and is small in a region on a neck portion side from the connected portion.

Generally, in a cathode-ray tube apparatus, an electron beam is deflected so as to scan (overscan) a region larger than a screen display region. When an electron beam strikes an inner wall surface of the funnel during overscanning, the electron beam reflected from the inner wall surface is incident upon a phosphor screen to allow a phosphor to emit light, whereby so-called cone halation occurs. This degrades image quality. The electron beam is likely to strike the inner wall surface of the funnel in the vicinity of a region of the funnel opposed to a deflection yoke.

In order to prevent the cone halation, the internal size of the funnel may be enlarged so that the electron beam does not strike the inner wall surface of the funnel even during overscanning.

However, in order to enlarge the internal size of the funnel in the above-mentioned conventional funnel in which the thickness is small in a region on the neck portion side from the difference in level, it is necessary to further reduce the thickness of the funnel. In the funnel, in order to limit an X-ray leakage amount to a predetermined value or less, it is necessary to use glass containing lead and maintain a predetermined thickness. Thus, when the thickness of the funnel is reduced, there is a new problem that an X-ray leakage amount increases.

In order to enlarge the internal size of the funnel while keeping a predetermined thickness, it is necessary to increase the external size of the funnel. However, there is an upper limit of the external size of the funnel in order to avoid the interference with the deflection yoke to be mounted on an outer circumferential surface of the funnel. If the internal size of the deflection yoke is increased so as to increase the external size of the funnel, the distance between the deflection yoke and the electron beam is enlarged to cause an increase in the required deflection power.

SUMMARY OF THE INVENTION

The present invention solves the above-mentioned conventional problem, and its object is to provide a cathode-ray tube apparatus capable of preventing cone halation while limiting an X-ray leakage amount to a predetermined value or less.

A cathode-ray tube apparatus of the present invention includes: a front panel with a phosphor screen formed on an inner surface; a funnel connected to the front panel; an electron gun housed in a neck portion of the funnel; and a deflection yoke provided on an outer circumferential surface of the funnel, and including a horizontal deflection coil for deflecting an electron beam emitted from the electron gun in a horizontal direction and a vertical deflection coil for deflecting the electron beam in a vertical direction. In a cross-section including a tube axis, assuming that T1 represents a thickness of the funnel at a point on the outer circumferential surface of the funnel, which is placed at the same position in a tube axis direction as that of an end of the horizontal deflection coil on the phosphor screen side, and T2 represents a thickness of the funnel at a point on the outer circumferential surface of the funnel, which is placed at the same position in the tube axis direction as a position 7 mm away from the end of the horizontal deflection coil on the phosphor screen side to the phosphor screen side along the tube axis, the funnel includes at least one cross-section taken along a plane including the tube axis that satisfies a relationship: $T2/T1 \geqq 1.18$.

These and other advantages of the present invention will become apparent to those skilled in the art upon reading and understanding the following detailed description with reference to the accompanying figures.

DESCRIPTION OF THE PREFERRED EMBODIMENTS

According to the present invention, a cathode-ray tube apparatus capable of preventing cone halation while limiting an X-ray leakage amount to a predetermined value or less can be provided.

Figure 1:
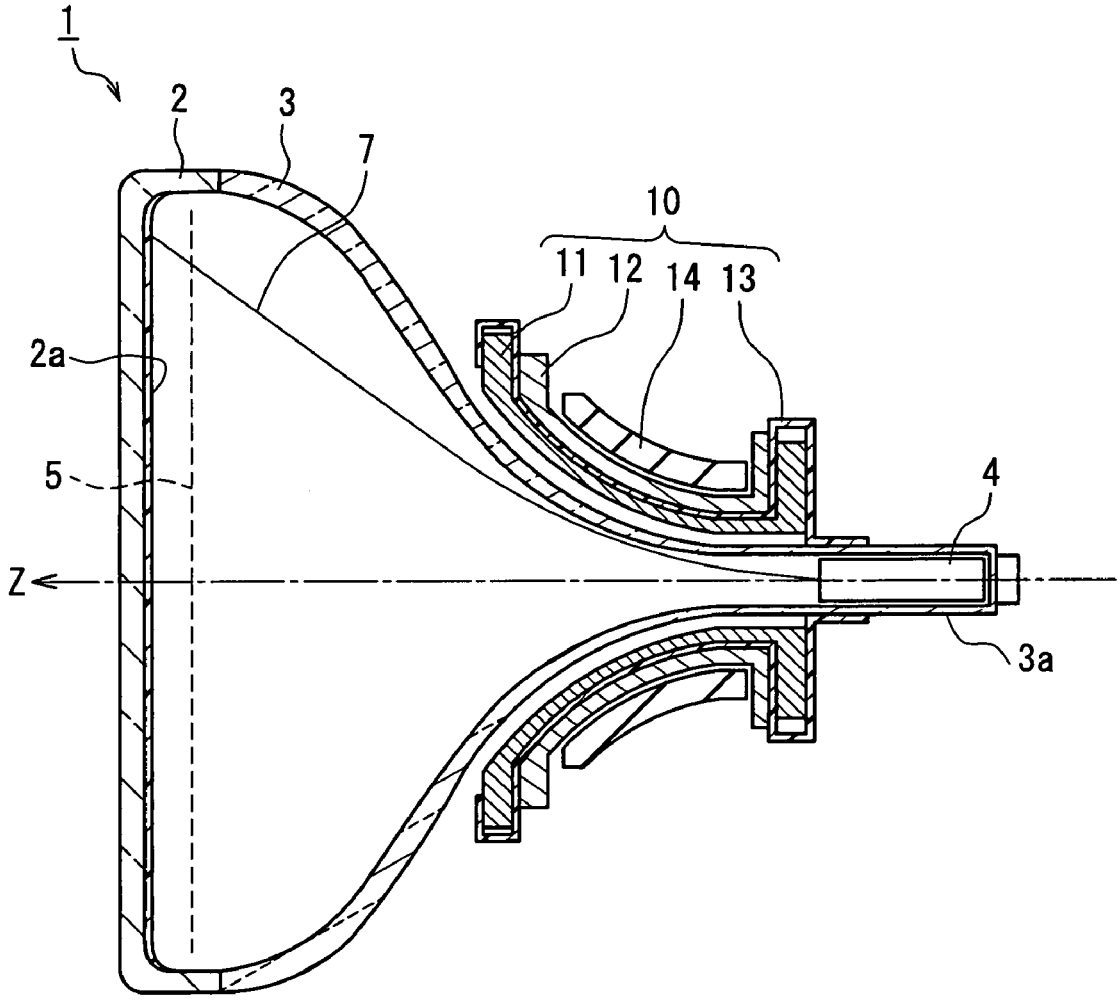
FIG. 1 is a cross-sectional view showing a schematic configuration of a cathode-ray tube apparatus according to one embodiment of the present invention.

FIG. 1 is a view showing a configuration of a cathode-ray tube apparatus according to one embodiment of the present invention. In FIG. 1, a Z-axis corresponds to a tube axis of a cathode-ray tube.

A cathode-ray tube (CRT) includes an envelope composed of a front panel 2 and a funnel 3, and an electron gun 4 provided in a neck portion 3*a* of the funnel 3. A cathode-ray tube apparatus 1 includes the cathode-ray tube and a deflection yoke 10 mounted on an outer circumferential surface of the funnel 3. On an inner surface of the front panel 2, a phosphor screen 2*a* is formed, in which respective phosphor dots (or phosphor stripes) of blue (B), green (G), and red (R) are arranged. A shadow mask 5 is attached to an inner wall surface of the front panel 2 so as to be opposed to the phosphor screen 2*a*. The shadow mask 5 is made of a metallic plate with a number of substantially slot-shaped apertures, which are electron beam passage apertures, formed by etching, and three electron beams 7 (shown as one electron beam in FIG. 1) emitted from the electron gun 4 pass through the apertures to strike predetermined phosphor dots.

The deflection yoke 10 deflects the three electron beams 7 emitted from the electron gun 4 in horizontal and vertical directions to allow them to scan the phosphor screen 2*a*. The deflection yoke 10 includes a saddle-type horizontal deflection coil 11, a saddle-type vertical deflection coil 12, and a ferrite core 14. An insulating frame 13 made of an insulating material (e.g., resin) is provided between the horizontal deflection coil 11 and the vertical deflection coil 12. The insulating frame 13 plays the role of maintaining electrical insulation between the horizontal deflection coil 11 and the vertical deflection coil 12 provided on an outer side of the horizontal deflection coil 11, as well as holding the horizontal deflection coil 11.

Figure 2:
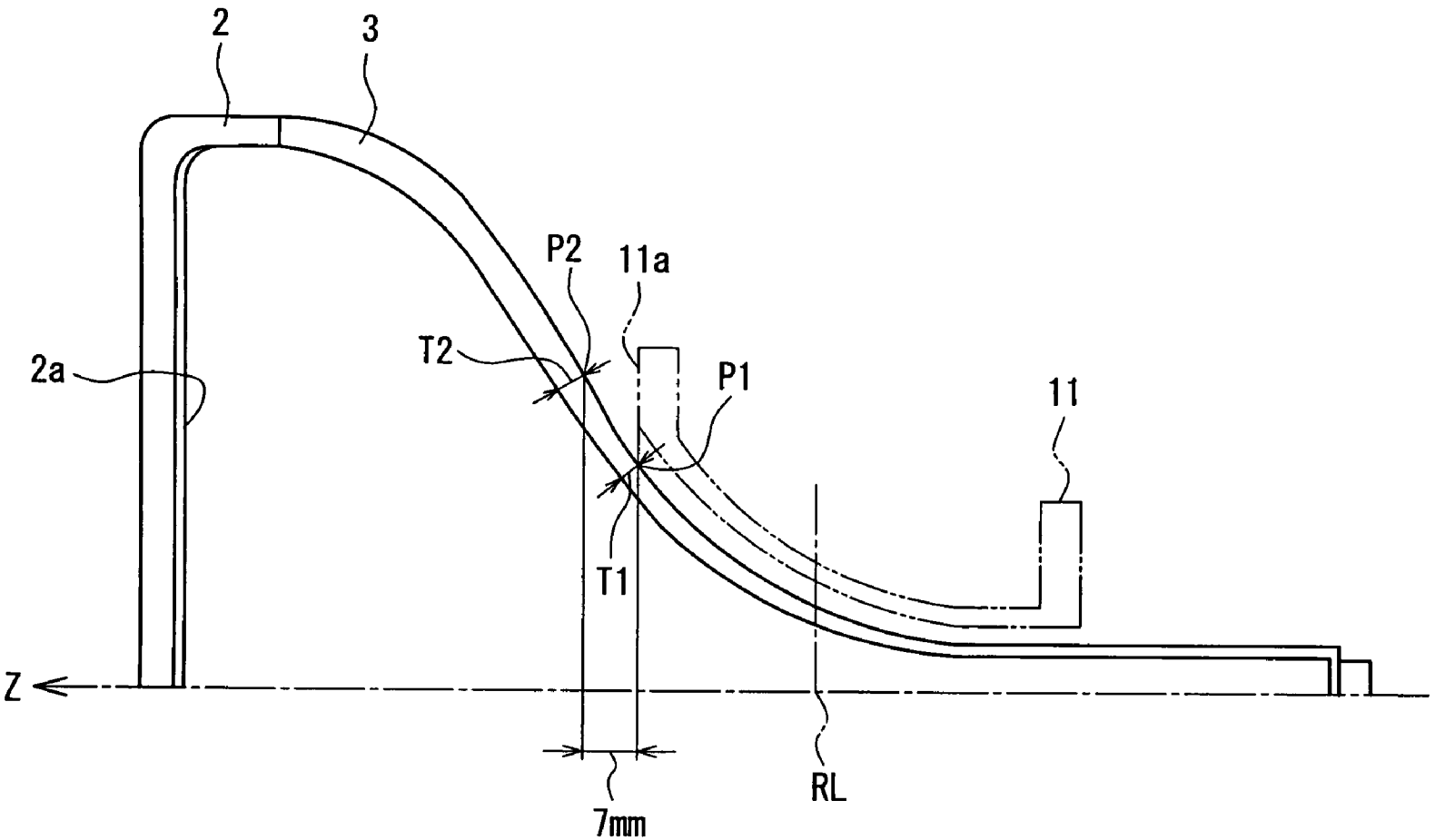
FIG. 2 is a partial cross-sectional view of an envelope composed of a front panel and a funnel in the cathode-ray tube apparatus according to one embodiment of the present invention.

FIG. 2 shows a partial cross-sectional view along the Z-axis of the envelope composed of the front panel 2 and the funnel 3. The cross-sectional shape of the envelope is symmetrical with respect to the Z-axis, so that FIG. 2 shows a partial cross-sectional view of the envelope. The horizontal deflection coil 11 of the deflection yoke 10 also is shown by an alternate long and two short dashes line.

According to the present invention, in a cross-section including the Z-axis, thicknesses T1, T2 of the funnel 3 at two points P1, P2 on the outer surface of the funnel 3 are defined. The first point P1 refers to a point on the outer surface of the funnel 3, which is placed at the same position in the Z-axis direction as that of an end 11*a* of the horizontal deflection coil 11 on the phosphor screen 2*a* side. The second point P2 refers to a point on the outer surface of the funnel 3, which is placed at the same position in the Z-axis direction as a position 7 mm away from the end 11*a* of the horizontal deflection coil 11 on the phosphor screen 2*a* side to the phosphor screen 2*a* side along the Z-axis. The thicknesses T1, T2 of the funnel 3 at the first and second points P1, P2 refer to the thickness of the funnel 3 along a line normal to the outer surface of the funnel 3 at the respective points P1, P2. The funnel 3 of the present invention includes at least one cross-section taken along a plane including the Z-axis where the thicknesses T1, T2 thus defined satisfy a relationship: $T2/T1 \geqq 1.18$. More specifically, the relationship: $T2/T1 \geqq 1.18$ is satisfied in at least one of a vertical cross-section including the Z-axis, a horizontal cross-section including the Z-axis, a diagonal cross-section including the Z-axis of a screen, and other cross-sections including the Z-axis.

The performance obtained by such a cross-sectional shape of the funnel 3 will be described by way of an example.

Using the funnel 3 in which the thicknesses T1, T2 defined as described above varies in three ways as shown in Table 1 in the cross-section including the Z-axis in the diagonal direction of a display screen, a wide-type color cathode-ray tube apparatus with a diagonal size of 28 inches and an aspect ratio of a display screen of 16:9 were produced (Examples 1, 2, 3, and Comparative Examples 1, 2).

Figure 3:
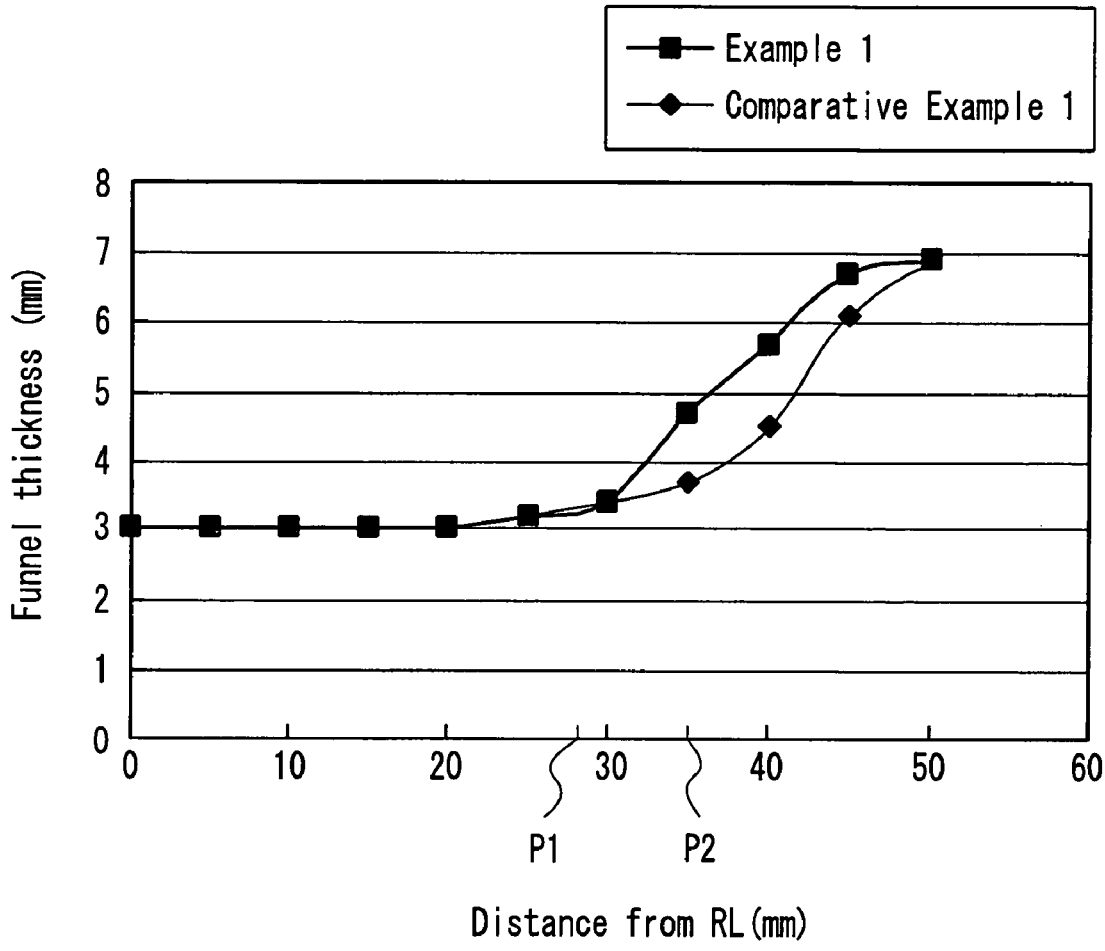
FIG. 3 is a diagram showing a change in thickness along a Z-axis of funnels in Example 1 and Comparative Example 1 in a cross-section including the Z-axis in a diagonal direction of a display screen.

FIG. 3 shows a change in thickness along the Z-axis in the cross-section including the Z-axis in the diagonal direction of a display screen, regarding the funnels 3 in Example 1 and Comparative Example 1. In FIG. 3, a horizontal axis represents a position on the Z-axis where the position of a reference line RL is an origin, and the phosphor screen 2*a* side is in a positive direction. Herein, the reference line RL is a virtual reference line vertical to the Z-axis, and the position of the reference line RL on the Z-axis is matched with a geometrical deflection center position of a cathode-ray tube. In Examples 1, 2, 3 and Comparative Examples 1, 2, the position on the Z-axis of the end 11*a* of the horizontal deflection coil 11 on the phosphor screen 2*a* side was 28 mm. Thus, the positions on the Z-axis of the first point P1 and the second point P2 were 28 mm and 35 mm, respectively.

As shown in FIG. 3, the thickness of each funnel 3 in Example 1 and Comparative Example 1 is relatively small in a region ($Z \leqq 28$ mm) where the horizontal deflection coil 11 is present and increases toward the phosphor screen 2*a* side beyond the first point P1 along the Z-axis in a positive direction of the Z-axis from the reference line RL. In Example 1, the thickness is larger in a region where Z=30 to 50 mm, compared with Comparative Example 1. The increase in thickness in Example 1 is realized mainly by setting the increase amount of an external size of the funnel 3 to be larger than that of an internal size thereof, as shown in FIG. 2.

Regarding the color cathode-ray tube apparatuses of Examples 1, 2, 3, and Comparative Examples 1, 2, cone halation brightness and an X-ray leakage amount were measured.

The cone halation brightness was obtained by measuring the brightness of a screen displayed when an electron beam strikes the inner surface of the funnel and is reflected therefrom to reach the phosphor screen in a case where the electron beam is allowed to perform overscanning of 110% respectively in vertical and horizontal directions with respect to the display screen. In Examples 1, 2, 3, and Comparative Examples 1, 2, the relative position between the funnel 3 and the deflection yoke 10 was adjusted so that the cone halation brightness was 0.15 (cd/mm$^2$). The value of the cone halation brightness of 0.15 (cd/mm$^2$) corresponds to an upper limit value at which cone halation is not recognized visually by the naked eye.

The X-ray leakage amount refers to a maximum value of X-ray intensity that is measured around the Z-axis while keeping a distance of 50 mm from an outside surface of a virtual cabinet defined by EIAJ ED-2112A, in a case where the electron beam is allowed to perform overscanning of 110% respectively in vertical and horizontal directions with respect to the display screen by applying a voltage of 40 kV to an anode.

Table 1 shows the measurement results.

TABLE 1

| | Example 1 | Example 2 | Example 3 | Comparative Example 1 | Comparative Example 2 |
|---|---|---|---|---|---|
| T1 (mm) | 3.3 | 3.3 | 3.3 | 3.3 | 3.3 |
| T2 (mm) | 4.7 | 4.2 | 3.9 | 3.7 | 3.5 |
| T2/T1 | 1.42 | 1.27 | 1.18 | 1.12 | 1.06 |
| Cone halation brightness (cd/mm$^2$) | 0.15 | 0.15 | 0.15 | 0.15 | 0.15 |
| X-ray leakage (pA/kg) | 0.7 | 1.4 | 2.2 | 5.1 | 4.8 |

In each of Examples 1, 2, and 3 in which the thickness of the funnel 3 satisfies the relationship: $T2/T1 \geqq 1.18$, the X-ray leakage amount is less than those in Comparative Examples 1 and 2 for the following reason.

A glass material constituting the funnel 3 contains lead, and as the thickness of the glass material is larger, the transmittance of an X-ray decreases. The leakage of an X-ray from the cathode-ray tube apparatus is likely to occur at a place where an electron beam strikes the funnel 3 and the vicinity thereof. The electron beam strikes the funnel 3 mainly in a region between the reference line RL and a point away from the reference line RL to the phosphor screen side by a predetermined distance (region where Z=about 0 to 50 mm in the present example).

In an area in which the deflection yoke 10 is opposed (area where Z=about 0 to 28 mm in the present example) in the above-mentioned region, even when an X-ray leaks, the deflection yoke 10 absorbs it, so that the amount of an X-ray leaking outside of the cathode-ray tube apparatus is small. Thus, according to the present invention, in this area, by setting the thickness of the funnel 3 to be small, the electron beam is prevented from striking the funnel 3 without enlarging the internal size of the deflection yoke 10. Owing to this, cone halation can be prevented without causing an increase in a deflection power and without increasing an X-ray leakage amount.

Furthermore, according to the present invention, in an area in which the deflection yoke 10 is not opposed (area where Z=about 28 to 50 mm in the present example) in the region of the funnel 3 to which the electron beam may strike, the thickness of the funnel 3 is set to be large, so that the X-ray leakage amount can be decreased. Furthermore, the increase in thickness in this area is realized mainly by enlarging the external size of the funnel 3, which can prevent the electron beam from striking the funnel 3, thereby preventing the occurrence of cone halation.

Thus, according to the present invention, a cathode-ray tube apparatus can be realized, which is capable of preventing cone halation while limiting an X-ray leakage amount to a predetermined value or less.

In Examples 1 to 3, the case where a relationship: $T2/T1 \geqq 1.18$ is satisfied in a cross-section including the Z-axis in a diagonal direction has been described. However, the present invention is not limited thereto. For example, the $T2/T1 \geqq 1.18$ may be satisfied in a cross-section including the Z-axis in a vertical direction, a horizontal direction, or other directions. It is preferable that the relationship: $T2/T1 \geqq 1.18$ is satisfied in a cross-section where the thickness T1 is minimum among a group of cross-sections including the Z-axis. In some cases, the thickness T1 of the funnel 3 at the first point P1 defined in each cross-section including the Z-axis may vary depending upon the direction of its cross-section around the Z-axis. Generally, the thickness T1 is set to be small mostly for the purpose of avoiding the electron beam from striking the vicinity of that portion. Thus, by allowing the $T2/T1 \geqq 1.18$ to be satisfied in a cross-section where the thickness T1 is minimum among a number of cross-sections composed of cross-sections in various directions including the Z-axis, the funnel capable of preventing the occurrence of cone halation without causing an increase in a deflection power and without increasing an X-ray leakage amount can be designed easily.

In the above-mentioned embodiment and examples, the thickness of the funnel 3 is varied by forming a difference in level on the outer surface of the funnel 3 so that the second point P2 protrudes beyond the first point P1. However, in terms of the production process of the funnel 3, it is preferable that the thickness of the funnel 3 is varied uniformly or smoothly in the Z-axis direction. Thus, it is not preferable that, on the phosphor screen 2*a* side with respect to the second point P2, unevenness is formed locally on the inner surface and/or the outer surface of the funnel 3 so that the thickness of the funnel 3 is reduced abruptly.

In the above-mentioned embodiment and examples, the exemplary color cathode-ray tube apparatus has been described. However, the present invention also is applicable to a cathode-ray tube apparatus of a monochromic display.

Furthermore, in the above-mentioned embodiment, the case where the vertical deflection coil 12 is of a saddle type has been illustrated. However, a toroidal vertical deflection coil also can be used.

The applicable field of the cathode-ray tube apparatus of the present invention is not particularly limited. For example, the present invention can be used widely in a television, a computer display, or the like.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A cathode-ray tube apparatus, comprising:

a front panel with a phosphor screen formed on an inner surface;

a funnel connected to the front panel;

an electron gun housed in a neck portion of the funnel; and a deflection yoke provided on an outer circumferential surface of the funnel, and including a horizontal deflection coil for deflecting an electron beam emitted from the electron gun in a horizontal direction and a vertical deflection coil for deflecting the electron beam in a vertical direction, wherein, in a cross-section including a tube axis, assuming that T1 represents a thickness of the funnel taken along a line normal to a point on the outer circumferential surface of the funnel, which is placed at the same position in a tube axis direction as that of an end of the horizontal deflection coil on the phosphor screen side, and T2 represents a thickness of the funnel taken along a line normal to a point on the outer circumferential surface of the funnel, which is placed at the same position in the tube axis direction as a position 7 mm away from the end of the horizontal deflection coil on the phosphor screen side to the phosphor screen side along the tube axis, the funnel includes at least one cross-section taken along a plane including the tube axis that satisfies a relationship: $T2/T1 \geqq 1.18$.

2. The cathode-ray tube apparatus according to claim 1, wherein the relationship: $T2/T1 \geqq 1.18$ is satisfied in a cross-section where the thickness T1 is minimum among a group of cross-sections including the tube axis.

* * * * *